US009254513B2

(12) United States Patent
Pawelski et al.

(10) Patent No.: US 9,254,513 B2
(45) Date of Patent: Feb. 9, 2016

(54) METHOD AND DEVICE FOR LUBRICATING ROLLERS AND A ROLLED STRIP OF A ROLLING STAND

(75) Inventors: Hartmut Pawelski, Ratingen (DE); Hans-Peter Richter, Friedewald (DE); Jürgen Seidel, Kreuztal (DE)

(73) Assignee: SMS group GMBH, Düsseldorf (DE)

( * ) Notice: Subject to any disclaimer, the term of this patent is extended or adjusted under 35 U.S.C. 154(b) by 867 days.

(21) Appl. No.: 13/000,281

(22) PCT Filed: Jun. 9, 2009

(86) PCT No.: PCT/EP2009/004138
§ 371 (c)(1),
(2), (4) Date: Jan. 25, 2011

(87) PCT Pub. No.: WO2009/156057
PCT Pub. Date: Dec. 30, 2009

(65) Prior Publication Data

US 2011/0111124 A1 May 12, 2011

(30) Foreign Application Priority Data

Jun. 18, 2008 (DE) ..... 10 2008 028 620
Jul. 21, 2008 (DE) ..... 10 2008 034 099
Oct. 2, 2008 (DE) ..... 10 2008 050 392

(51) Int. Cl.
*B21B 45/02* (2006.01)
*B21B 27/10* (2006.01)
(Continued)

(52) U.S. Cl.
CPC ..... *B21B 45/0251* (2013.01); *B21B 27/10* (2013.01); *B21B 45/0245* (2013.01); *B21B 37/32* (2013.01); *B21B 38/02* (2013.01); *B21B 45/0248* (2013.01); *B21B 45/0263* (2013.01)

(58) Field of Classification Search
USPC ..... 427/421.1
See application file for complete search history.

(56) References Cited

U.S. PATENT DOCUMENTS 3,301,029 A 1/1967 Fritzlen et al.
3,789,641 A 2/1974 Miller et al.
4,750,343 A 6/1988 Richter
(Continued)

FOREIGN PATENT DOCUMENTS

CN 1518483 8/2004
CN 1596167 3/2005
(Continued)

OTHER PUBLICATIONS

Use of Lubricants in Hot Steel Rolling, Al Alawi et al.
(Continued)

*Primary Examiner* — Nathan T Leong
(74) *Attorney, Agent, or Firm* — Lucas & Mercanti, LLP; Klaus P. Stoffel

(57) ABSTRACT

A method for lubricating rolls, especially work rolls (2, 3) of a rolling stand, and rolling stock (6) passed between the rolls during the rolling operation, in which a lubricant-gas mixture, a lubricant-water-gas mixture, a lubricant-water mixture and/or a grease-medium mixture is applied to the rolls (2, 3) or the rolling stock (6) on the run-in side of the rolling stand, is characterized by the fact that the mixture is prepared with at least one mixing device (14, 17, 27, 29, 31, 35) in the area upstream of the rolling stand.

10 Claims, 13 Drawing Sheets

(51) Int. Cl.

| | |
|---|---|
| *B21B 37/32* | (2006.01) |
| *B21B 38/02* | (2006.01) |

(56) References Cited

U.S. PATENT DOCUMENTS

| | | | | |
|---|---|---|---|---|
| 5,090,225 | A | 2/1992 | Schimion | |
| 5,692,682 | A * | 12/1997 | Soule | 239/403 |
| 6,450,000 | B2 | 9/2002 | Barten | |
| 6,923,385 | B2 * | 8/2005 | Koponen | 239/424 |
| 7,172,141 | B2 | 2/2007 | Nakayama | |
| 7,266,984 | B2 | 9/2007 | Cerv | |
| 8,001,820 | B2 | 8/2011 | Pawelski | |
| 2004/0217184 | A1 | 11/2004 | Seidel | |
| 2004/0232258 | A1 * | 11/2004 | Cerv et al. | 239/407 |
| 2008/0149026 | A1 * | 6/2008 | Cedoz et al. | 118/308 |
| 2009/0151415 | A1 * | 6/2009 | Inoue et al. | 72/236 |
| 2011/0094829 | A1 | 4/2011 | Seidel | |

FOREIGN PATENT DOCUMENTS

| | | | |
|---|---|---|---|
| DE | 102005042020 | | 3/2007 |
| DE | 102005042020 | Y | 3/2007 |
| EP | 1829625 | | 9/2007 |
| JP | S58159910 | A | 9/1983 |
| JP | S59118211 | A | 7/1984 |
| JP | S60238014 | A | 11/1985 |
| JP | S6114009 | A | 1/1986 |
| JP | H0290957 | A | 3/1990 |
| JP | H038510 | A | 1/1991 |
| JP | H1058002 | A | 3/1998 |
| JP | 2001347307 | A | 12/2001 |
| JP | 2006255764 | A | 9/2006 |
| JP | 2006263740 | A | 10/2006 |
| JP | 2006263741 | A | 10/2006 |
| JP | 2007160367 | A | 6/2007 |
| JP | 2007237230 | A | 9/2007 |
| JP | 2007253178 | A | 10/2007 |
| KR | 1020040007746 | | 1/2004 |
| SU | 869881 | | 10/1981 |
| SU | 1579594 | | 7/1990 |
| WO | 03000437 | | 1/2003 |
| WO | 03002277 | | 1/2003 |
| WO | 2008148438 | | 12/2008 |

OTHER PUBLICATIONS

Schlick, Mischdüsen, Injektoren Modellreihe 803-804 Druckmischdüsen Modellreihe 770-772.

Schlick, Drei- Und Vierstoffdüsen Modellreihe 946-0/56.

Development of Hot Rolling Oil, Kihara et al.

Transparente Schmierstoffe für Die Warmformgebung Von Stahl, Buschmann et al.

* cited by examiner

METHOD AND DEVICE FOR LUBRICATING ROLLERS AND A ROLLED STRIP OF A ROLLING STAND

BACKGROUND OF THE INVENTION

The invention concerns a method for lubricating rolls, especially work rolls of a rolling stand, and rolling stock passed between the rolls during the rolling operation, in which a lubricant-gas mixture, a lubricant-water-gas mixture, a lubricant-water mixture, and/or a grease-medium mixture is applied to the rolls or the rolling stock on the run-in side of the rolling stand.

The rolling stand comprises several mutually supporting rolls, including, for example, a work roll, which comes into direct contact with the rolling stock and in turn rolls on a generally larger backup roll or intermediate roll. Many hot rolling mills for rolling a metal strip have an integrated roll gap lubricating system. These systems are used for the purpose of improving the surface quality of the work roll and the strip and have become part of the standard equipment of a rolling mill on which high-quality strip is to be produced. In one widely used system, a mixture of water as the base medium with oil is applied to the rolling stock or to the work roll or backup roll.

In the cold rolling process, lubrication is customary. In this case, lubricant is applied to the rolling stock and/or to the work roll and/or is sprayed into the roll gap. The mixing of the oil and water is carried out far from the rolling stand. In most cases, an emulsion is used, which, in a complicated process in a circulation system, is separated, cleaned and resupplied to the lubricating system.

WO 03 002277 A1 discloses a method and a device for cooling and/or lubricating rolls, especially work rolls, of a rolling stand, in which water in the form of spray jets is used as a cooling medium, and oil, an oil-air mixture, an oil-water mixture, an oil-water-air mixture, or grease mixtures are used as lubricants. To improve the lubricating and cooling effect, the combined use of supercooling of the strip and roll surface and roll lubrication on the run-in side of the rolling stand is proposed, in which the two media—water and lubricant—are supplied separately to the rolls and the rolling stock and are applied to different points of application on the surface of the roll. Separate supply lines to the spray bars are provided for water and the lubricant.

SUMMARY OF THE INVENTION

The objective of the invention is to create a simplified method of lubrication during the rolling of a metal strip, which can be used both in cold rolling and in hot rolling.

In accordance with the invention, this objective is achieved in a method of the aforementioned type by preparing the mixture with at least one mixing device in the area upstream of the rolling stand. In the cold rolling process, much as in the hot rolling process, the goal of the new lubricating method is to produce the lubricant just before its use or application and thus to avoid the complicated preparation in a closed circulation. To realize economical use of the method, a further goal of the invention is to minimize the amount of lubricant that is used. The same goal also applies to the use of the lubricating method of the invention for hot rolling. While reducing the amount of lubricant that is used, at the same time it is intended that the lubricating action be optimized and that it be possible to adjust the lubricating effect.

Examples of lubricants that can be used are oil-water dispersions, oil-water emulsions, oil-free water-miscible lubricants, oil-air mixtures, or oil-water-air mixtures. The media can be sprayed in 2-, 3- or 4-component nozzles.

To reduce the amount of lubricant, it is especially advantageous to atomize the lubricant with air. In a preferred embodiment, oil and water are mixed just before being atomized with air. This makes it possible to apply even extremely small amounts of oil to the surfaces of the rolls or to the rolling stock. In the case of hot rolling, the mixing of oil and water has the advantage, compared to the use of pure oil, that there is no fire hazard.

In the case of cold rolling, the new method of lubrication has the advantage that the oil concentration in the lubricant can be varied very quickly and flexibly. In this way, the lubricant can be optimally adjusted to different materials to be rolled, to different strip speeds, to varying drafts, and to the given rolling stand. In addition, it is also possible to prepare different oils and lubricants for different applications.

Since the amounts of lubricant are so small that just the roll and/or strip surface is wetted, there is no need for a complicated preparation process. The used lubricant, together with the water from the cooling systems and possibly other oil leakages, is conveyed to the wastewater treatment plant, and the oil is separated there.

Advantageous refinements of the invention are described in the dependent claims.

One of the advantageous provisions of the invention is that water and at least one lubricant are conveyed to a mixer through separate supply lines and are mixed in the mixer to form a water-lubricant dispersion or emulsion. In this connection, it can be provided that the water-lubricant dispersion or emulsion is atomized in atomizing nozzles by means of a gas, especially air, and applied to at least one of the work rolls and/or to the rolling stock.

3-component or 4-component mixing nozzles or atomizing nozzles, in which the water, the one or more lubricants, and the air are mixed, are preferably used. Naturally, it is possible, in accordance with the invention, to use a gas other than air or to use a mixture of gases.

Preferably, the one or more lubricants are first mixed with the water in a supply line to form a mixture, and then the mixture is mixed with the gas in the inner chamber of the 3-component or 4-component mixing nozzle. Alternatively, the water, the one or more lubricants, and the gas are mixed in the inner chamber of the 3-component or 4-component mixing nozzle.

The lubricant-gas mixture, the lubricant-water-gas mixture, the lubricant-water mixture and/or the grease-medium mixture is preferably distributed over the entire width of at least one of the work rolls and/or the rolling stock.

It has also been found to be advantageous if the amount of water, the one or more lubricants, the gas, the lubricant-gas mixture, the lubricant-water-gas mixture, the lubricant-water mixture and/or the fat-medium mixture is distributed by means of control valves over the width of at least one of the work rolls and/or the rolling stock.

In another embodiment of the method, it is provided that the amount and/or the pressure of the one or more lubricants, the water, the lubricant-water mixture, the lubricant-gas mixture, and/or the fat-medium mixture is automatically controlled over the width of at least one of the work rolls and/or the rolling stock by means of the control valves and/or in flowmeters, pressure controllers, and/or in mixing blocks.

It can also be provided that the one or more lubricants, water and gas are mixed in a 3-component nozzle, wherein the amount of lubricant is automatically controlled in sectors over the width of at least one of the work rolls and/or the rolling stock, and that the pressure and/or the volume of the gas and the water is automatically controlled.

Alternatively, the mixing operation is realized in such a way that the one or more lubricants and the gas are mixed in a mixing block and that water is then added in 2-component mixing nozzles. In this case, the water can be admixed outside an inner nozzle tube of the 2-component mixing nozzles.

In another advantageous embodiment of the method, the one or more lubricants are mixed with the gas, especially in a mixing block, and sprayed by nozzles onto at least one of the rolls and/or the rolling stock, while water is sprayed next to the nozzles.

Preferably, a flatness control system is used to automatically control the supply of the one or more lubricants in zones over the width.

The invention also concerns a device for lubricating at least one roll and/or rolling stock rolled between the rolls in a rolling stand.

In accordance with the invention, the device is characterized by the fact that it has at least one mixing block and/or multicomponent mixing devices, especially atomizing nozzles, for mixing water, gas, and at least one lubricant, especially an oil, to form a lubricant-gas mixture, a lubricant-water-gas mixture, or a lubricant-water mixture.

It is advantageous for the device to have automatic control devices, especially control valves, for determining the amount of the mixture to be sprayed by spray devices onto at least one of the rolls and/or onto the rolling stock.

It is advantageous for the automatic control devices to be arranged in zones over the width of the one or more rolls or the rolling stock. In this connection, it is also possible to provide flowmeters and pressure controllers.

The multicomponent mixing devices are designed either as internal mixers or external mixers. Preferably, they comprise a turbulence plate or a venturi tube.

It is advantageous to provide water spray bars above and/or below spray devices for spraying a lubricant-containing mixture onto at least one roll and/or onto the rolling stock. This has a fire protection effect in the case of hot rolling. Flammable oil or lubricant is shielded by a water spray curtain and thus cannot heat up and cause a fire.

In addition, it is advantageous to equip the device with an automatic control device for controlling the flatness of the rolled strip by evaluating signals of a flatness measuring device, especially a flatness measuring roller.

The flatness measuring device preferably comprises a flatness measuring roller, which generates signals that correspond to the flatness of the rolled strip and relays the signals to the spray devices for the purpose of adjusting the amounts or concentrations of the one or more lubricants. The use of the flatness measuring device makes it possible to consider even higher order flatness of the rolled strip by evaluation of the signals of the flatness measuring roller, and corrective measures can be taken, for example, by changing the amounts or concentrations of the lubricant.

The spray devices are preferably arranged in two rows essentially parallel to the axis of the roll, especially offset from each other, so that even in the event of failure of some of the spray nozzles, adequate lubrication of the roll surface or of the rolling stock can still be guaranteed.

The invention also concerns a rolling stand, in which a device of the type described above is used for lubricating a roll and/or the rolling stock.

The invention is explained in greater detail below with reference to specific embodiments.

DETAILED DESCRIPTION OF THE INVENTION

Figure 3:
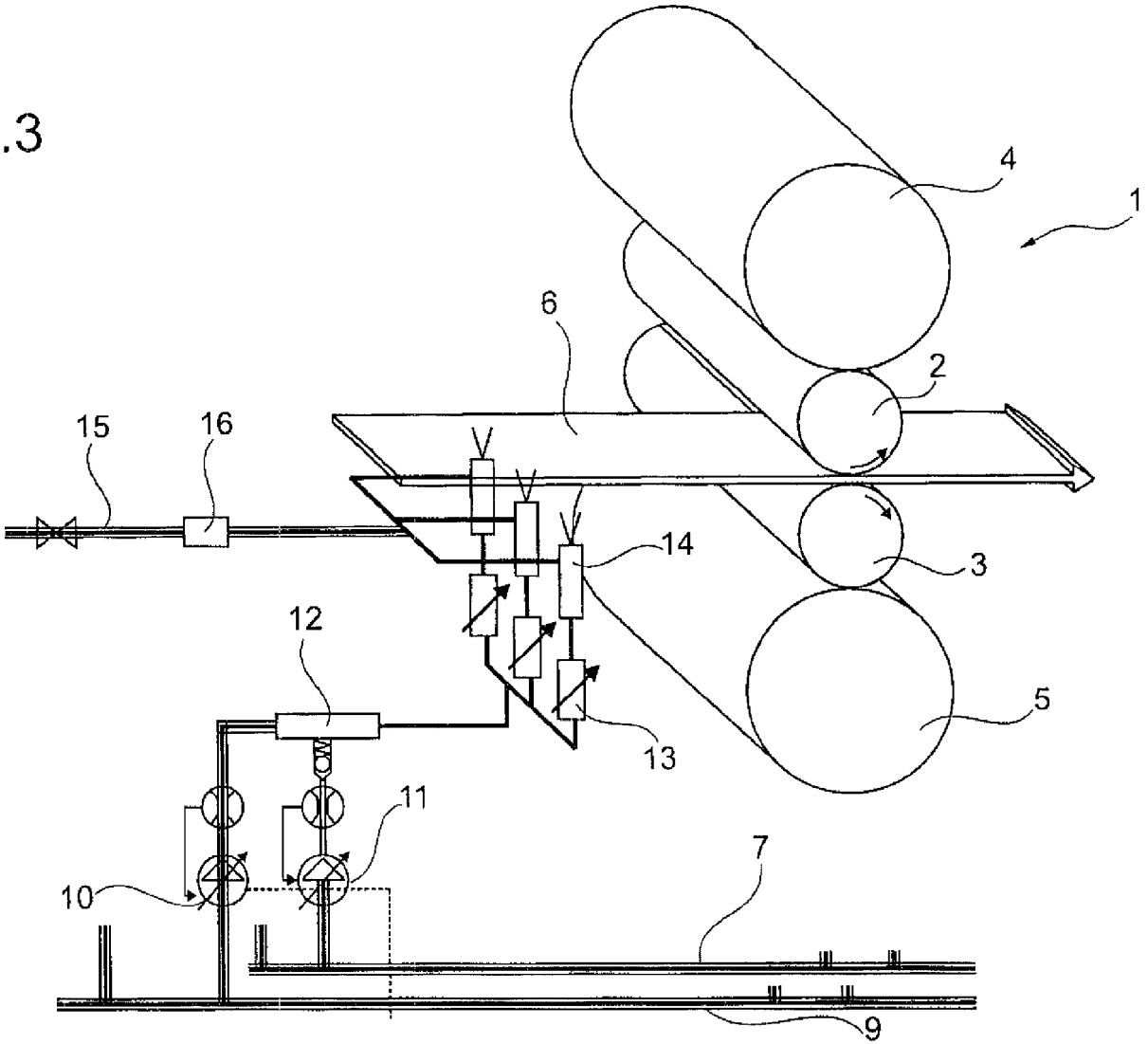
FIG. 3 shows a rolling installation with an oil-water-air lubricating system, which has a lubricant supply that is variable over the width and in which the lubricant is sprayed onto the underside of the rolling stock.

A rolling installation 1 (FIG. 1) comprises two work rolls 2, 3, which are supported between two backup rolls 4, 5 and roll rolling stock 6 (FIG. 3). In this operation, a lubricant, especially a first and a second oil, or additional oils and water are first supplied via separate supply lines 7, 8, and 9. First, the two oils are mixed together. Alternatively, only one oil or the other is used. The desired amounts of water and the two oils are adjusted by metering pumps 10, 11 and pumped to a mixer 12. A dispersion or emulsion of the two liquids brought together in this way is formed downstream of the mixer 12. To avoid separation of the mixture, the distance between the mixer 12 and control valves 13 downstream of the mixer is preferably very small, or the mixer and control valves are constructed as a single unit. The control valves 13 are distributed over the entire width of the upper work roll 2. If relatively long pipelines cannot be avoided, turbulence plates (mixers) are installed a certain distance apart in the lines. The pipeline cross section is preferably selected as small as possible in order to realize a flow rate as high as possible and thus a short conveyance time. To be able to adjust a lubricant load over the width of the work roll 2 and also to be able to adjust it as a function of the width of the rolling stock 6 that is being processed, the control valves 13 deliver lubricant to downstream atomizing nozzles 14, which are designed as 2-component mixing nozzles, according to the width of the rolling stock 6. In the atomizing nozzles 14, air is added to the mixture of lubricant and water. The air is supplied through a line 15 with a pressure controller for adjusting the air pressure. The amounts of lubricant or oil and the amounts of water are adjusted by a computer model and/or an automatic control device, which takes into account the various lubricating properties as a function of the strip material to be rolled, the strip speed, the draft, the temperatures and other parameters. The activation of the control valves 13 and the amounts pumped by the metering pumps 10, 11 are coordinated with each other. The automatic control device determines the lubricant concentrations or the types of lubricants and also carries out automatic crown and flatness control of the rolled strip 6. Unflatness of the rolled strip 6 is then compensated by adjusting the amounts of lubricant supplied or by varying other parameters. If necessary, the level of rolling force can be controlled by varying the amount of oil, the type of oil, the concentration of oil in the water and/or the oil mixing proportions.

Figure 2:
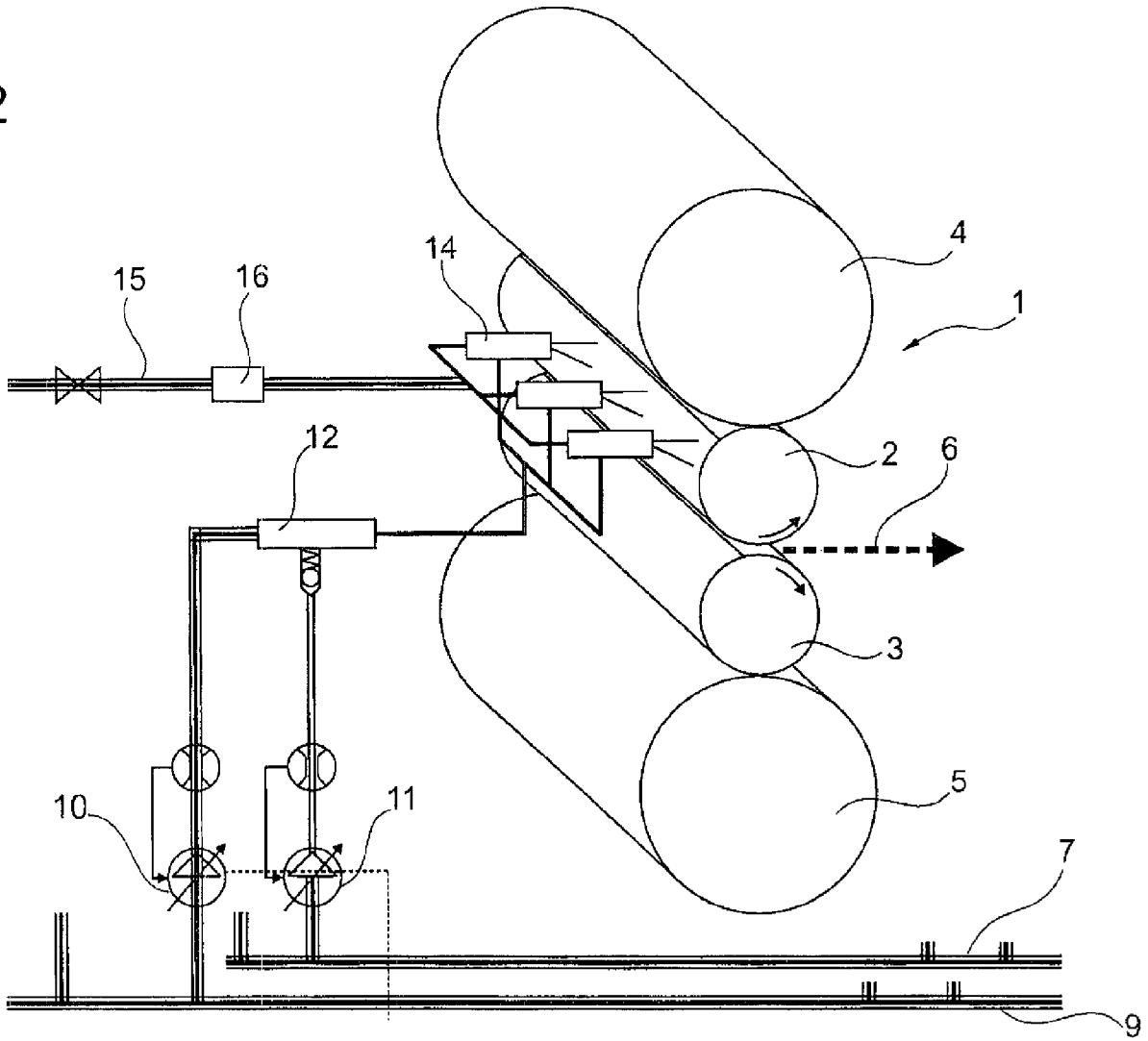
FIG. 2 shows a rolling installation with an oil-water-air lubricating system, in which the lubricant is sprayed onto the upper work roll in equal amounts over the length.

In a simplified embodiment of the rolling installation 1 (FIG. 2), there are no control valves 13. In this case, the flow through the atomizing nozzles 14 is manually adjusted or results from the adjustment of the metering pump. In another embodiment (FIG. 3), the lubricant-water-air mixture is applied directly to the underside of the rolling stock 6. Control valves 13 are also provided in this case.

Figure 4:
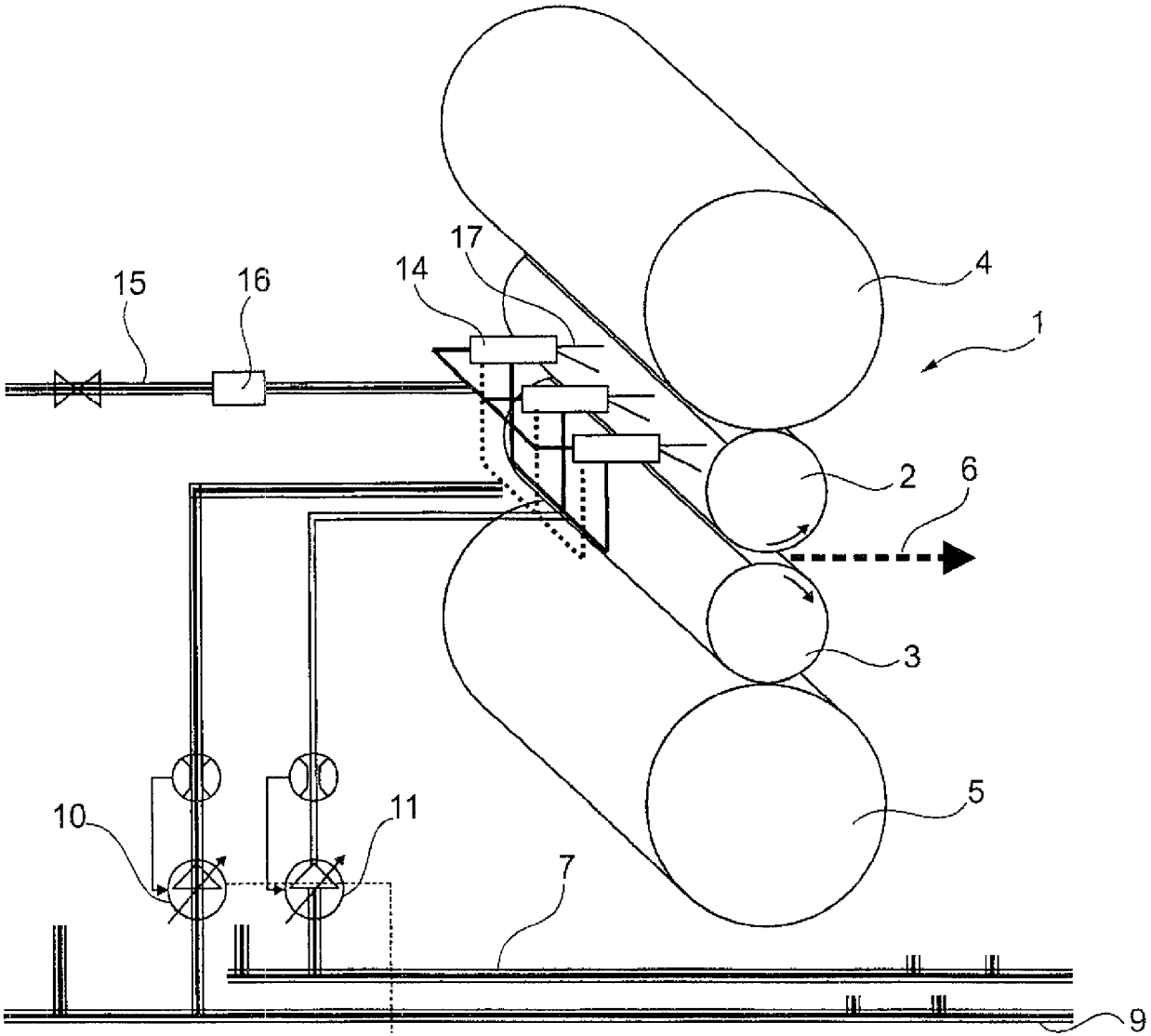
FIG. 4 shows a rolling installation with an oil-water-air lubricating system, which has a plurality of 3-component mixing nozzles with gas-liquid atomizers and in which the lubricant is sprayed onto the upper work roll.

In another embodiment (FIG. 4), water, the lubricant, for example, oil, and air are first supplied through separate lines 7, 9, 15 and then applied to the upper work roll 2 by atomizing nozzles 14 or 17 in the form of 3-component nozzles, wherein the mixing and atomizing of the fluids constitute a unit in the atomizing nozzles 17. However, in this case as well, control devices can be provided, which individually control the supply of the given fluid to the individual atomizing nozzles 17 or to a group of atomizing nozzles. Preferably, all of the individual automatic control devices are integrated in an automatic control system, which determines the volume and the mixing proportions of the fluids that are delivered by the atomizing nozzles 17 to the work roll 2 or the rolling stock 6. Naturally, in all of the embodiments (FIGS. 1 to 4), analogous designs are provided or can be provided for supplying a lubricant-water-air mixture to the lower work roll 3 and/or to the upper side of the rolling stock 6.

Figure 5:
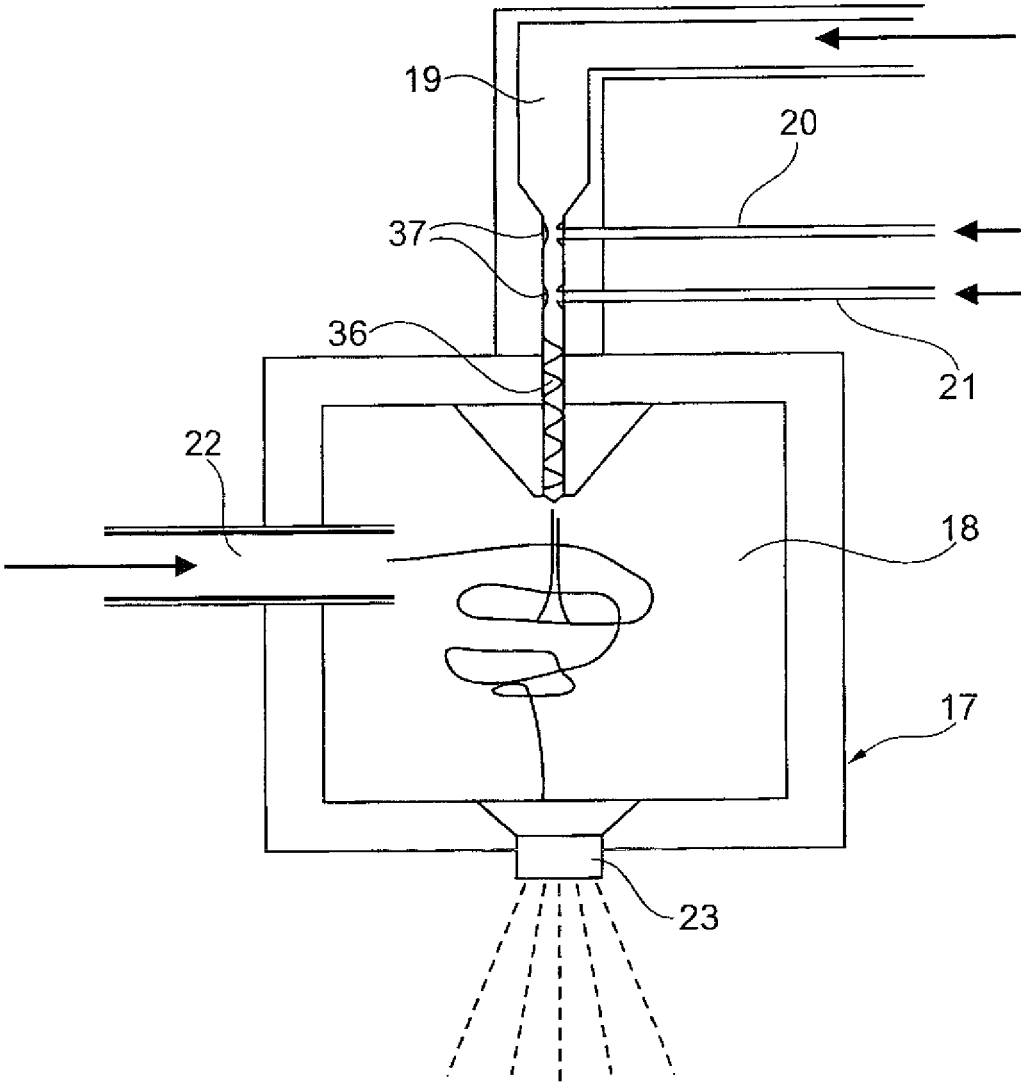
FIG. 5 shows an embodiment of a 3- or 4-component mixing nozzle for mixing water, lubricant and gas, as used, for example, in the rolling installation illustrated in FIG. 3.

An atomizing nozzle 17 (FIG. 5) is realized as an internal mixer pressure mixing nozzle with an inner chamber 18, into which water and two lubricants are fed at one end through a supply line 19 and, if necessary, are mixed by means of, e.g., turbulence plates 36 or a pipe constriction 37. The operation of mixing the liquids takes place just before the atomization. The mixer and nozzle constitute a unit here. Two lines 20, 21 first carry the lubricants into the supply line 19 immediately before the lubricants are delivered into the inner chamber 18. A gas, especially air, enters the inner chamber 18 through another feed line 22 and is mixed in the inner chamber 18 with the mixture of water and the two lubricants. The mixture then leaves the nozzle orifice 23 in a conical spray and strikes the surface of a roll or the surface of the rolling stock 6. Since the lubricant (for example, oil) or a plurality of lubricants is the most important component, it is also possible, in accordance with the invention, to control only the individual amount of oil per atomizing nozzle 17 and to control the other components in sections, i.e., over relatively large sections of the width of a roll and/or the width of the rolling stock 6. The lubricant or lubricants can also be applied solely with the use of compressed air, i.e., without the use of water. In this case, a 2-component nozzle is used.

Figure 6:
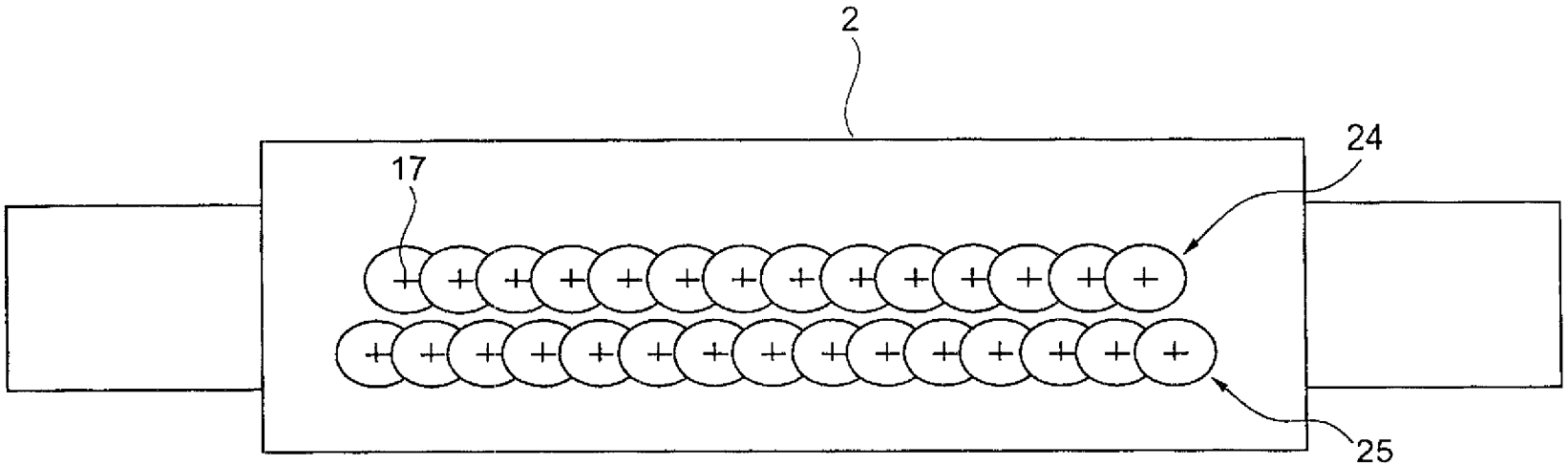
FIG. 6 shows a two-row arrangement of mixing nozzles for applying lubricant to a roll or rolling stock.

Especially in the case of cold rolling, it is important that the lubricant film acts completely over the entire width of the rolling stock 6. If the oil film breaks down, undesirable scratches are produced on the surface. To guarantee redundancy of the lubricant effect, two or more rows 24, 25 (FIG. 6) of atomizing nozzles 17 are preferably provided opposite a roll, for example, work roll 2, or opposite the rolling stock 6. The atomizing nozzles 17 in the two or more rows 24, 25 are preferably offset from one another. Alternatively, a one-row nozzle spray bar can be used, whose nozzles have a large angle of spray, so that double coverage is realized. This means that if one nozzle fails, the adjacent nozzles cover this area.

Figure 1:
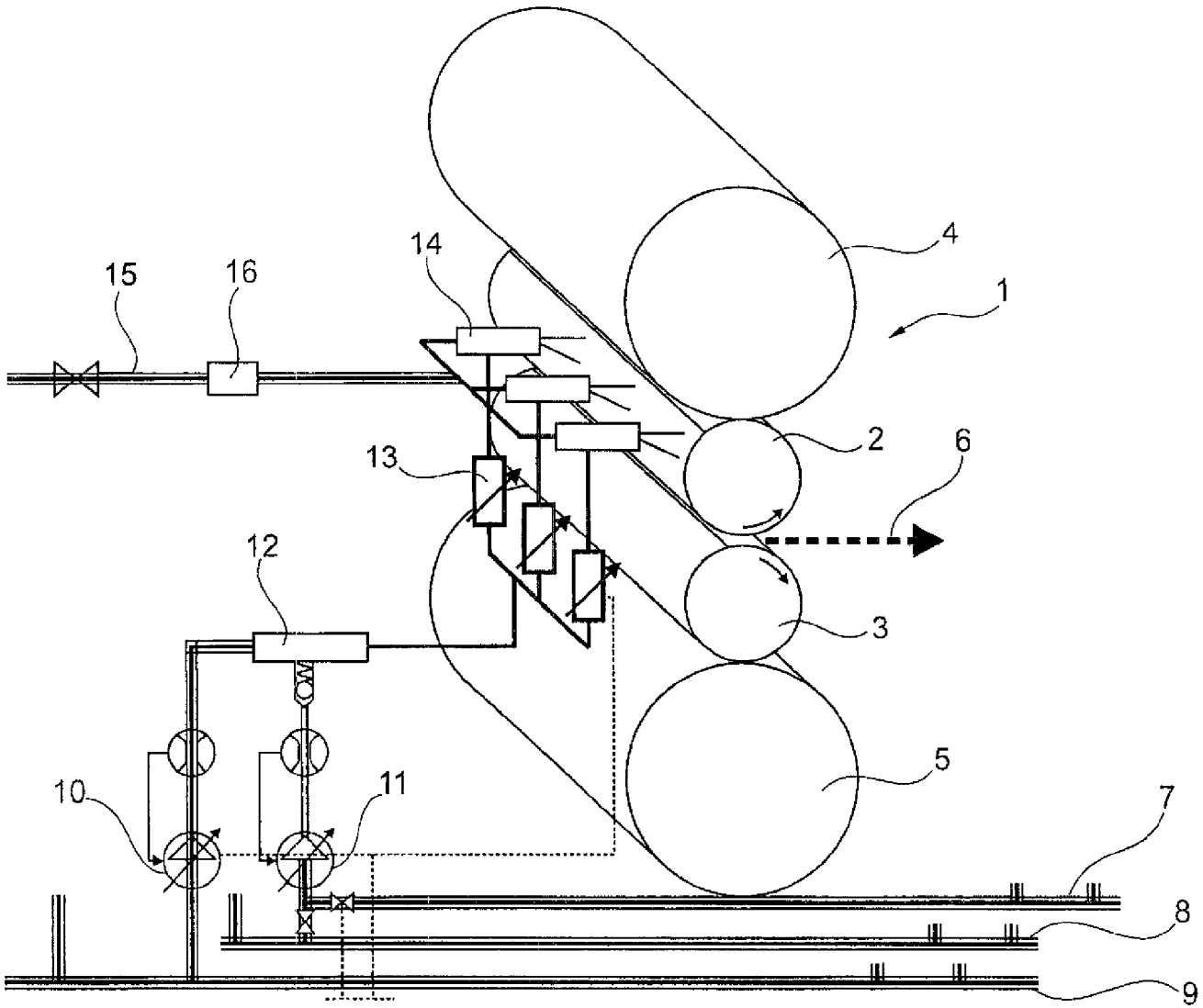
FIG. 1 shows a rolling installation with an oil-water-air lubricating system, which has a lubricant supply that is variable over the width and in which the lubricant is sprayed onto the upper work roll.
Figure 7:
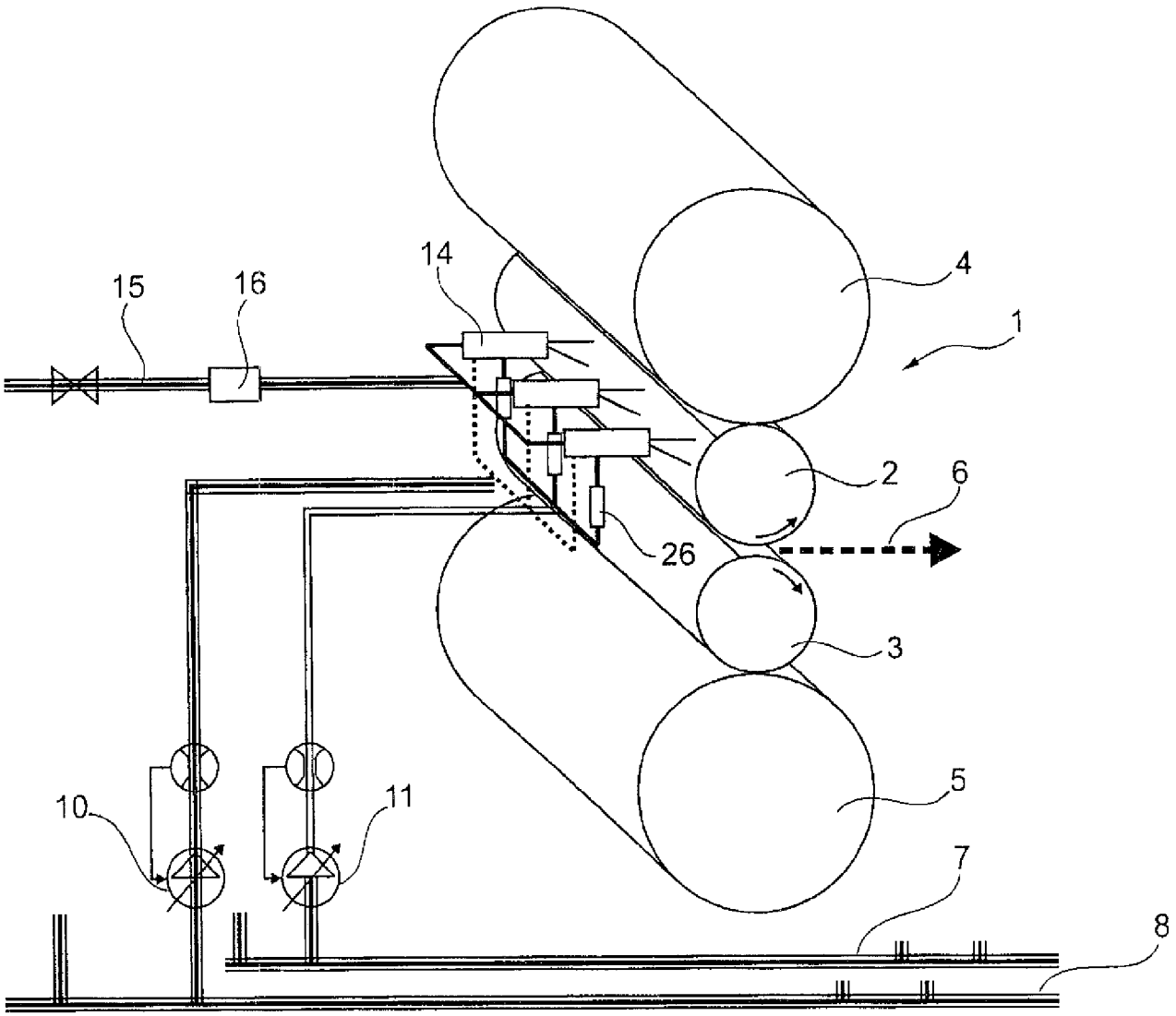
FIG. 7 shows a rolling installation with an oil-water-air lubricating system with a plurality of 3-component mixing nozzles with gas-liquid atomizers and with control valves assigned to each 3-component mixing nozzle for automatically controlling the amount of lubricant, in which the lubricant is sprayed onto the upper work roll.

Similarly to the embodiments illustrated in FIGS. 1 and 3, other embodiments of the invention have automatic control devices 26 (FIG. 7), with which the supply of the lubricant to each atomizing nozzle 14 is individually controlled over the entire width of the strip. The overall effect of the lubrication can be further influenced by varying the amounts of water and air. In the case of hot rolling, lubricant is applied to at least one of the work rolls 2, 3, while in the case of cold rolling, lubricant is preferably applied to the rolling stock 6.

Figure 8:
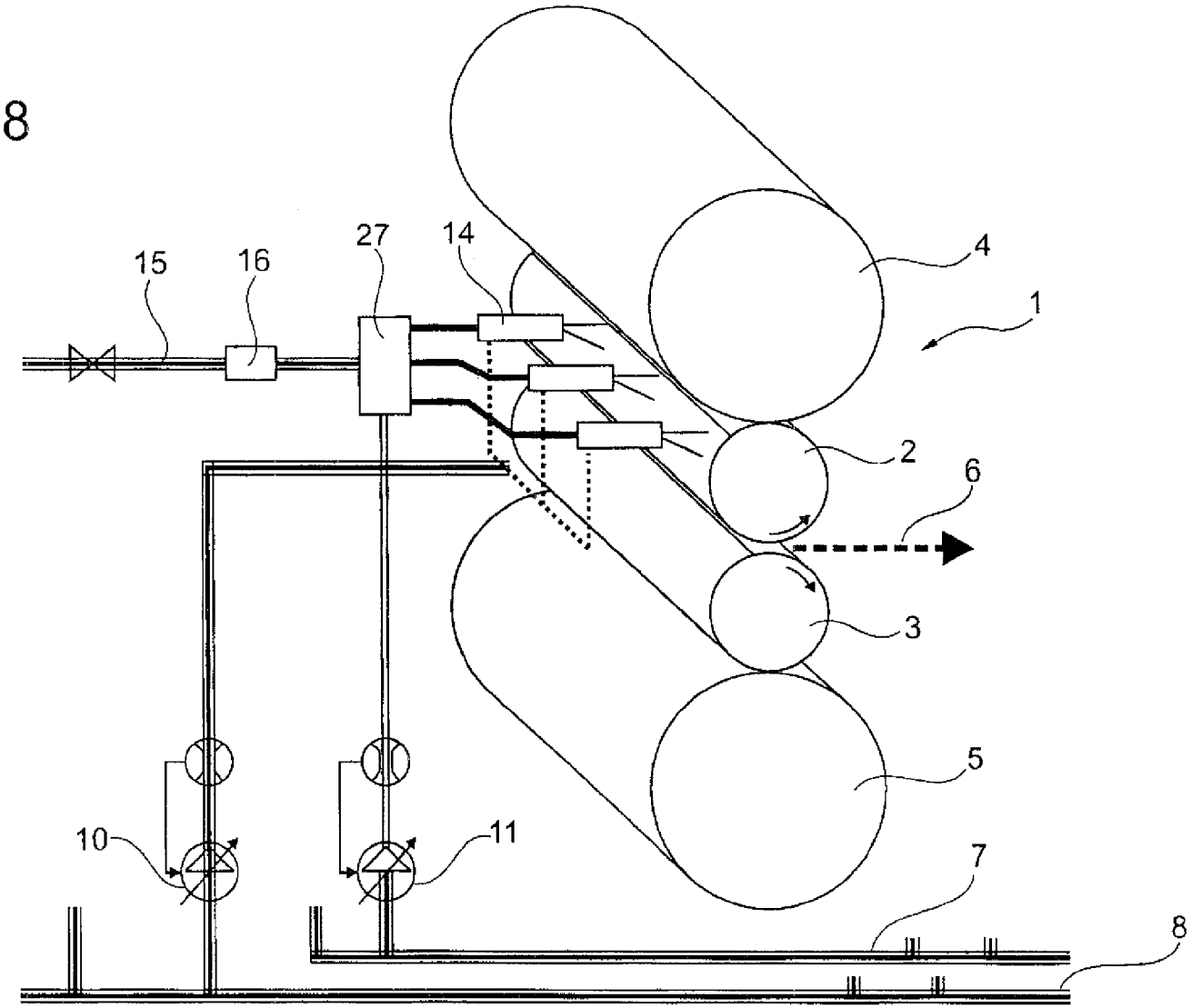
FIG. 8 shows a rolling installation with an oil-water-air lubricating system, in which lubricant and gas are mixed in a mixing block, and water is added in a plurality of 2-component mixing nozzles, and the lubricant is sprayed onto the upper work roll.

According to another variant (FIG. 8), lubricant and air are brought together in a mixing block 27. The air carries the lubricant to the atomizing nozzles 14. Each of the nozzles 14 is individually fed. The water is supplied to the nozzles 14 separately.

Figure 9:
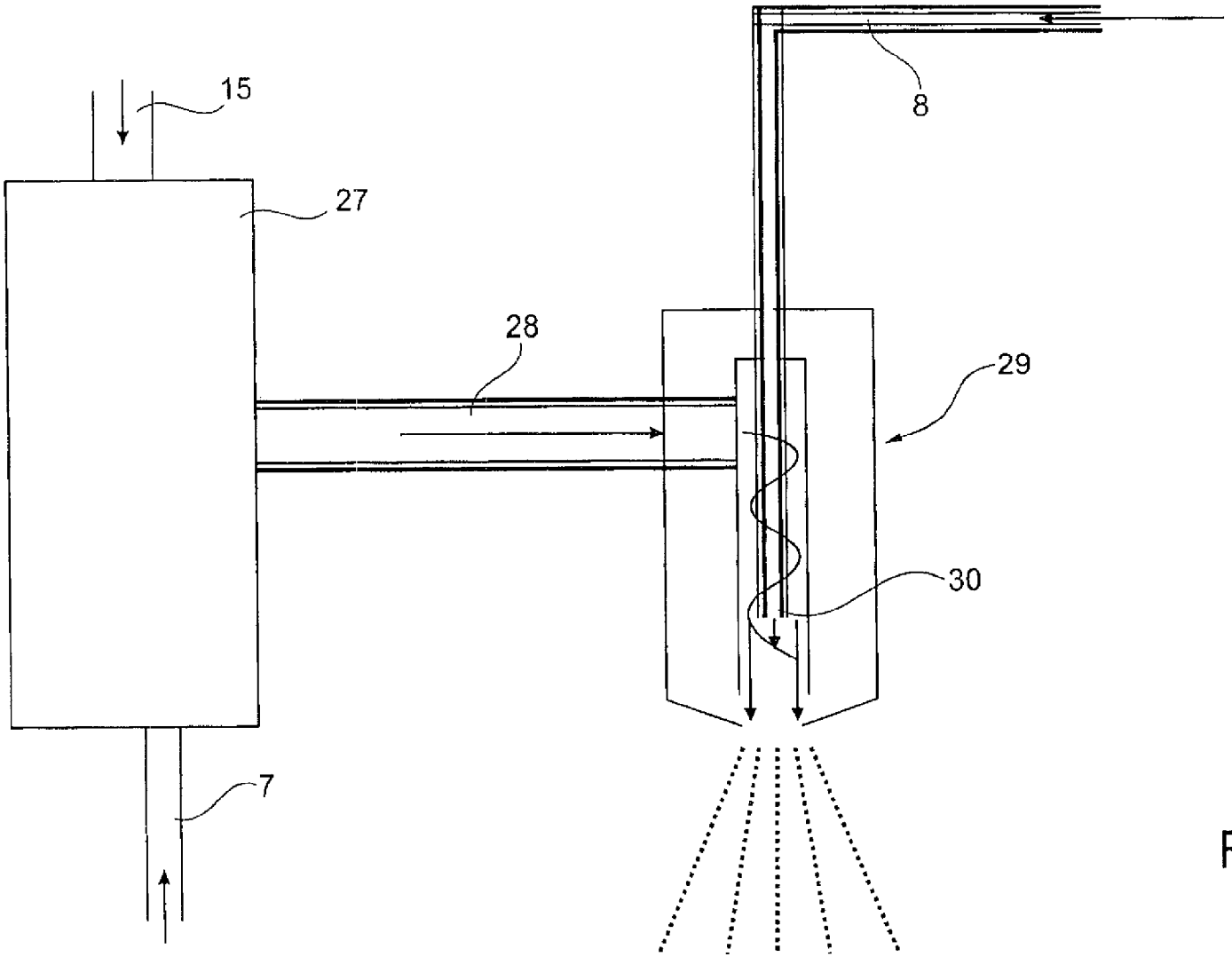
FIG. 9 shows the mixing block according to FIG. 8 in combination with a 2-component mixing nozzle in longitudinal section, wherein the media mix outside the mixing nozzle.

In the mixing block 27 (FIG. 9), first the lubricant and air from the lines 7 and 15 are brought together. The mixture is then fed by a line 28 to a 2-component nozzle 29, in which it is combined with water supplied by the line 8. The 2-component nozzle 29 is designed as an external mixer. This means that the lubricant-air mixture and the water do not come together until they reach the nozzle orifice 30. The mixing is made possible by two hollow cones formed by the fluids spraying into each other. The advantage of this 2-component nozzle 29 is that saponification is prevented, since the lubricant and water do not come into contact with each other until they arrive at the nozzle orifice 30. The water supply can be shut off to realize pure lubricant-air lubrication.

Figure 10:
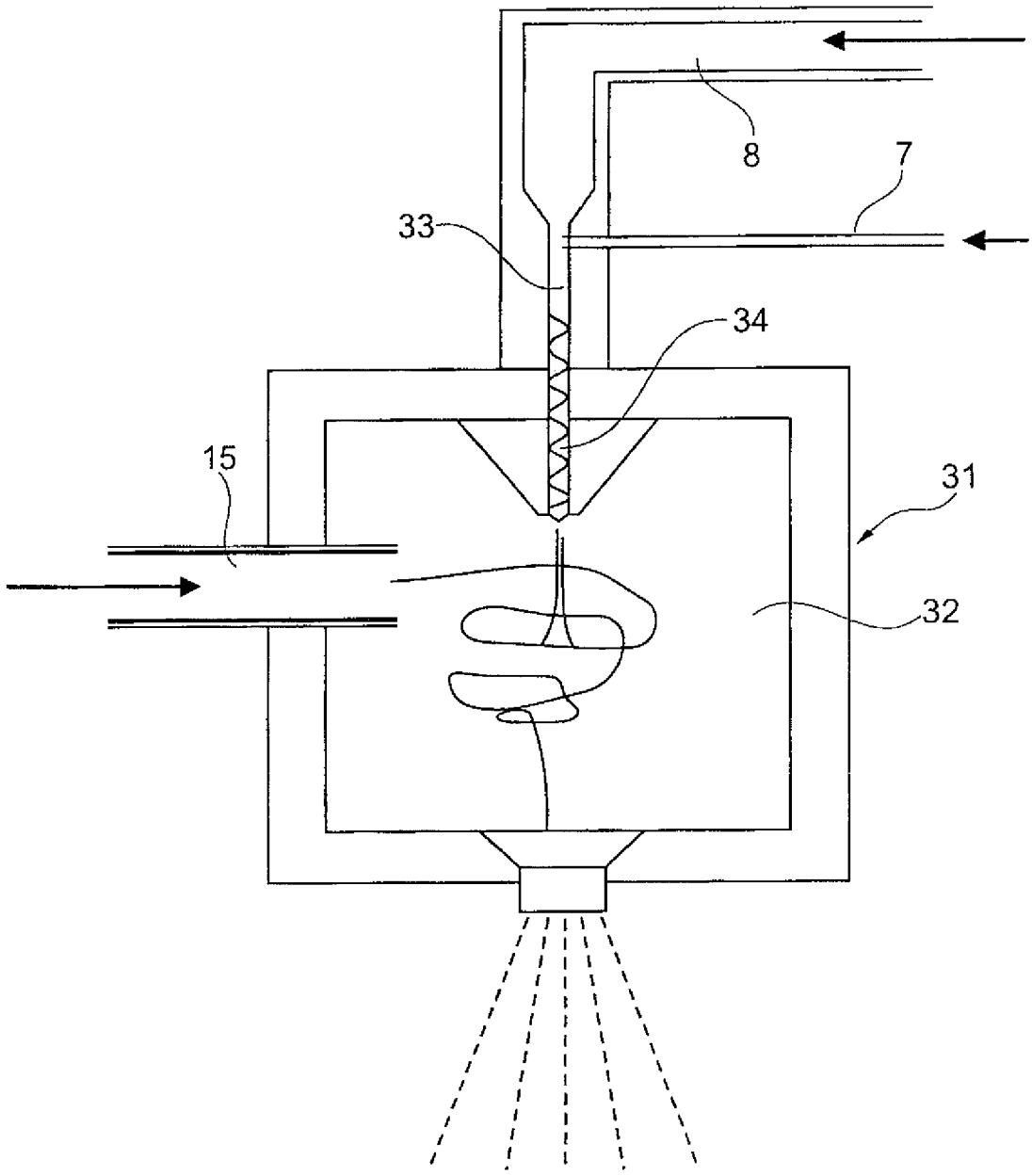
FIG. 10 shows a 3-component mixing nozzle for mixing water, lubricant and gas with a mixture of the liquid media before entrance into the medium chamber in longitudinal section.

In a 2-component nozzle 31 (FIG. 10), which is designed as an internal mixer with an inner chamber 32, oil and water are first introduced together into the inner chamber 32 through a feed line 33, and air is introduced separately. Turbulence plates 34 or a venturi tube is installed in the oil-water supply line 33 to guarantee thorough mixing of the media.

Figure 11:
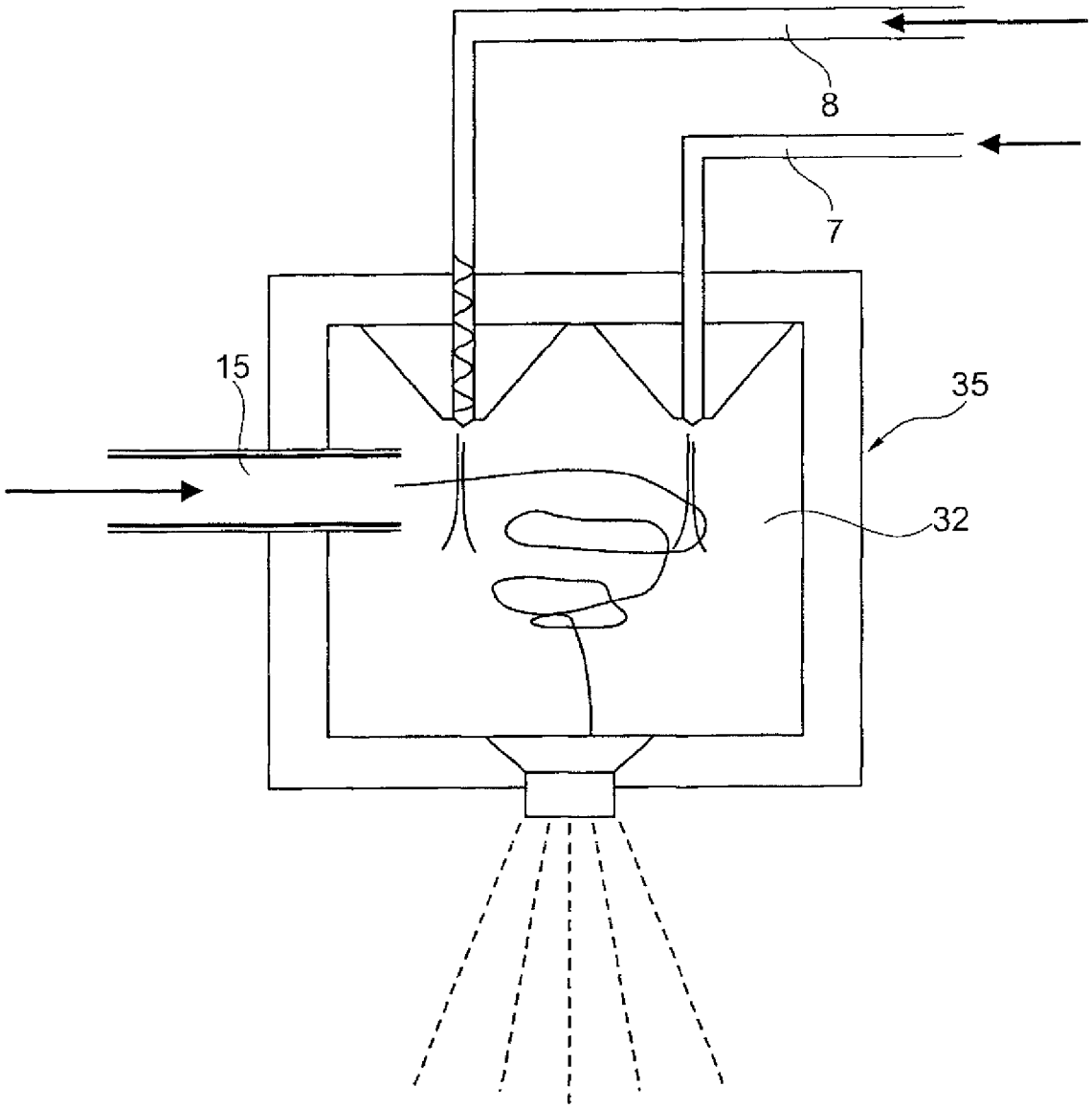
FIG. 11 shows another 3-component nozzle for mixing water, lubricant and gas with a mixture of the liquid media before entrance into the medium chamber in longitudinal section, wherein all of the media mix in the medium chamber.

A 3-component nozzle (FIG. 11) likewise has an inner chamber 32, into which the media oil, water and air are separately fed through lines 7, 8, and 15. The liquid media are thus not mixed until they reach the inner chamber 32, and they are then atomized and sprayed.

Figure 12:
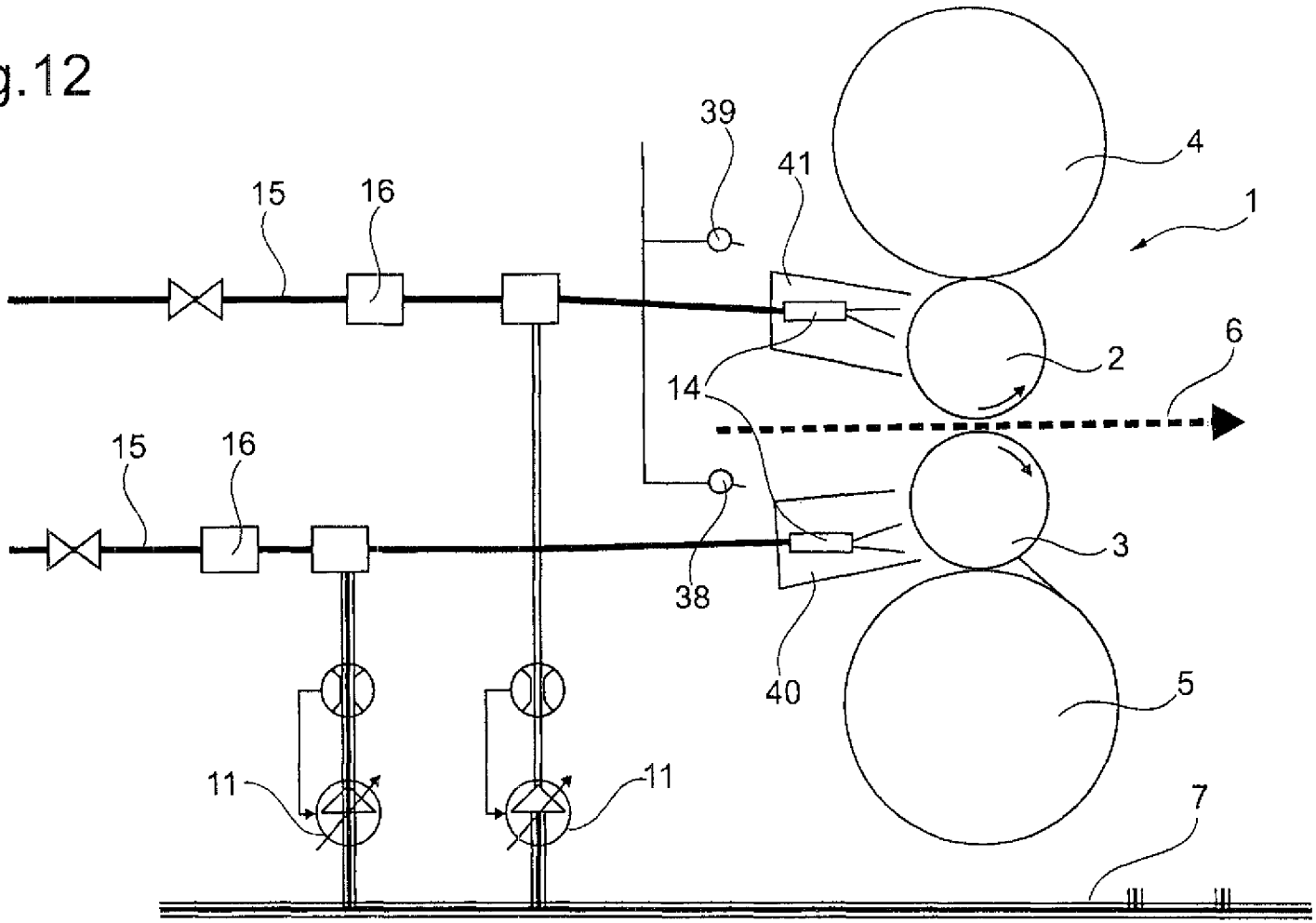
FIG. 12 shows a rolling installation with an oil-water-air lubricating system, in which lubricant and gas are mixed in a mixing block, the lubricant is sprayed onto both work rolls, and at the same time water spray bars are provided as fire protection devices.

When one wishes to use an oil-air mixture without having to add water as an additional component, then in the case of hot rolling, provision is made for fire protection, when necessary, by producing a water curtain that shields the oil-air mixture towards the outside by means of water spray bars 38, 39 (FIG. 12). In addition, shielding walls 40, 41 are placed around the oil-air mist produced by the atomizing nozzles 14. The oil-air mist can be exhausted to the outside. The shielding walls 40, 41 as well as the nozzle spray bars 14 are designed to swivel in order to improve the shielding and to allow the nozzles to be placed just in front of the roll. Similar exhausting is also provided for the lubricant application to the rolling stock (in the case of cold rolling).

Figure 13:
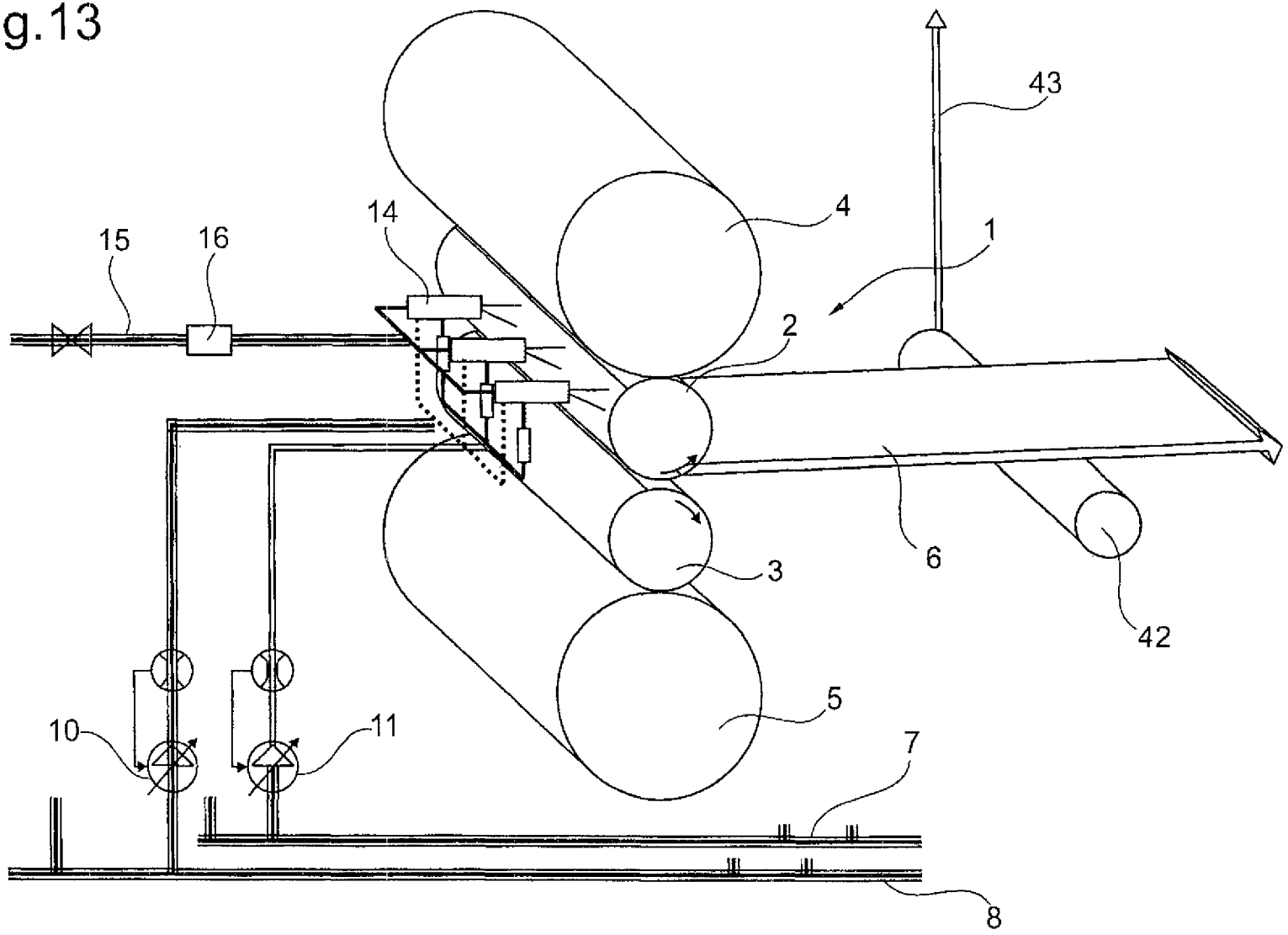
FIG. 13 shows the rolling installation according to FIG. 7 but with the addition of a flatness measuring roller and a flatness control system.

In another embodiment of the invention, to control the surface structure (flatness, uniform state of stress) of the rolled strip 6, a flatness measuring roller 42 (FIG. 13) or other type of contactless (optical) flatness measuring system is provided to determine unevenness of the rolled strip 6. This measuring system transmits signals via a signal line 43 to an evaluation unit (not shown here). The evaluation unit generates signals for controlling or regulating the atomizing nozzles 14 or control valves 13 to deliver properly adjusted amounts of lubricant to the work roll 2 over the width of the strip. Parabolic or higher order strip flatness can be influenced by the amount or concentration of lubricant delivered per zone. Naturally, corresponding automatic control can also be applied with respect to the lower work roll 3. The atomizing nozzles 14 can also spray the lubricant directly onto the rolling stock 6 to influence the strip flatness and the strip stress distribution over the width of the strip.

LIST OF REFERENCE NUMBERS

1 rolling installation
2 work roll
3 work roll
4 backup roll
5 backup roll
6 rolling stock/rolled strip
7 supply line
8 supply line
9 supply line
10 metering pump
11 metering pump
12 mixer
13 control valves
14 atomizing nozzles (multicomponent nozzles)
15 line
16 pressure controller
17 atomizing nozzles (multicomponent nozzles)
18 inner chamber
19 supply line
20 line
21 line
22 supply line
23 nozzle orifice
24 row
25 row
26 automatic control device
27 mixing block
28 line
29 multicomponent nozzle
30 nozzle orifice
31 multicomponent nozzle
32 inner chamber
33 supply line
34 turbulence plate
35 multicomponent nozzle
36 turbulence plate
37 pipe constriction
38 spray bar
39 spray bar
40 wall
41 wall
42 flatness measuring roller
43 signal line

The invention claimed is:

1. A method for lubricating rolls of a rolling stand and rolling stock passed between the rolls during the rolling operation, comprising the steps of:

applying a lubricant-water mixture to the rolls or the rolling stock on a run-in side of the rolling stand:

preparing the mixture with at least one mixing device in an area upstream of the rolling stand, including conveying water and at least one lubricant to a mixer through separate supply lines and mixing the water and lubricant in the mixing device to form a water-lubricant dispersion or emulsion, and wherein the water-lubricant dispersion or emulsion is atomized in atomizing nozzles using a gas, wherein the gas conveys the dispersion or emulsion through a line from the mixer to a respective one of the atomizing nozzles where the dispersion or emulsion is applied by the gas to at least one of the work rolls and/or to the rolling stock, and wherein the atomizing nozzles are arranged over a width of the at least one of the work rolls and/or the rolling stock; and providing each of the atomizing nozzles with a control valve for individually controlling the amount of the atomized lubricant dispersion or emulsion applied by the gas to the at least one of the work rolls and/or the rolling stock.

2. The method in accordance with claim 1, including mixing the water, the at least one lubricant, and a gas in multicomponent mixing nozzles or atomizing nozzles.

3. The method in accordance with claim 2, wherein the nozzles and mixers for the fluids form a unit.

4. The method in accordance with claim 2, including mixing the water, the at least one lubricant, and the gas in an inner chamber of a 3-component or 4-component mixing nozzle.

5. The method in accordance with claim 1, including distributing the lubricant-water mixture over an entire width of at least one of the work rolls and/or the rolling stock.

6. The method in accordance with claim 1, including distributing an amount of water, the at least one lubricant, the gas, and/or the lubricant-water mixture by the control valves over a width of at least one of the work rolls and/or the rolling stock, and automatically controlling the amount and/or pressure of the at least one lubricant, the water and/or the lubricant-water mixture over the width of at least one of the work rolls and/or the rolling stock by using the control valves and/or in flowmeters, pressure controllers, and/or in mixing blocks over the width of at least one of the work rolls and/or the rolling stock.

7. The method in accordance with claim 1, including mixing the at least one lubricant, water, and gas in a 3-component nozzle, where an amount of lubricant is automatically controlled in sectors over a width of at least one of the work rolls and/or the rolling stock, and where the pressure and/or the volume of the gas and the water is automatically controlled.

8. The method in accordance with claim 1, including mixing the at least one lubricant and the gas in a mixing block and the adding water in 2-component mixing nozzles, and admixing the water outside an inner nozzle tube of the 2-component mixing nozzles.

9. The method in accordance with claim 1, wherein the gas conveys the lubricant from the mixing block through a single line to the nozzle and only there is mixed and atomized inside or outside the nozzle and sprayed by nozzles onto at least one of the rolls and/or the rolling stock.

10. The method in accordance with claim 1, including using a flatness control system to automatically control a supply of the at least one lubricant in zones over a width of the work rolls and/or the rolling stock, and varying a level of rolling force or flexibly adapting to changed rolling conditions by varying an amount of lubricant, a type of lubricant, a concentration of a lubricant in the water, and/or mixing proportions of different types of lubricants.

* * * * *